US012383810B2

(12) United States Patent
Chen et al.

(10) Patent No.: US 12,383,810 B2
(45) Date of Patent: Aug. 12, 2025

(54) ARTIFICIAL SHUTTLECOCK

(71) Applicant: VICTOR RACKETS INDUSTRIAL CORP., Taipei (TW)

(72) Inventors: Shu-Jung Chen, Taipei (TW); Tzu-Wei Wang, Taipei (TW); Hsin-Chen Wang, Taipei (TW)

(73) Assignee: VICTOR RACKETS INDUSTRIAL CORP., Taipei (TW)

( * ) Notice: Subject to any disclaimer, the term of this patent is extended or adjusted under 35 U.S.C. 154(b) by 203 days.

(21) Appl. No.: 18/482,186

(22) Filed: Oct. 6, 2023

(65) Prior Publication Data

US 2024/0123311 A1 Apr. 18, 2024

(30) Foreign Application Priority Data

Oct. 14, 2022 (TW) ..... 111211253

(51) Int. Cl.
*A63B 67/18* (2016.01)
*A63B 67/187* (2016.01)

(52) U.S. Cl.
CPC ..... *A63B 67/187* (2016.01); *A63B 2209/02* (2013.01)

(58) Field of Classification Search
CPC ..... A63B 67/187; A63B 67/19
See application file for complete search history.

(56) References Cited

U.S. PATENT DOCUMENTS

| | | | | |
|---|---|---|---|---|
| 6,709,353 | B1 * | 3/2004 | Peterson | A63B 67/187 473/580 |
| 8,992,355 | B2 * | 3/2015 | Yoneyama | A63B 67/187 473/580 |
| 9,061,193 | B2 * | 6/2015 | Dai | A63B 67/187 |
| 9,937,399 | B1 * | 4/2018 | Peterson | A63B 67/187 |
| 10,065,096 | B2 * | 9/2018 | Chen | A63B 67/19 |
| 10,576,346 | B2 * | 3/2020 | Sakaguchi | A63B 67/19 |
| 10,814,196 | B2 * | 10/2020 | Chen | A63B 67/19 |
| 10,857,440 | B2 * | 12/2020 | Matsushima | A63B 67/187 |
| 2014/0155201 | A1 | 6/2014 | Yoneyama | |
| 2022/0219057 | A1 | 7/2022 | Chen et al. | |

FOREIGN PATENT DOCUMENTS

| | | |
|---|---|---|
| CN | 109481921 A | 3/2019 |
| JP | S53-25466 | 3/1978 |
| KR | 2021-0111989 A | 9/2021 |

* cited by examiner

*Primary Examiner* — John A Ricci
(74) *Attorney, Agent, or Firm* — Best & Flanagan LLP

(57) ABSTRACT

An artificial shuttlecock includes a ball head, a plurality of feathers, and a plurality of stems. Each of the feathers includes a notch. The notch is disposed on an outer edge of the feather. A ball head end of the stem is connected to the ball head, and a feather end is connected to the feather. The stem includes a body, which tapers from the end close to the ball end to the feather end. The end of the body close to the ball end has a first width, and the body has a second width at the feather. The first width is between 2.1 mm and 2.4 mm, and the second width is between 0.4 mm and 0.6 mm.

10 Claims, 4 Drawing Sheets

ARTIFICIAL SHUTTLECOCK

BACKGROUND

1. Technical Field

The present disclosure relates to an artificial shuttlecock, and more particularly, to a stem of the artificial shuttlecock.

2. Description of the Related Art

Badminton is a common and popular ball game, in which players use racquets to hit a shuttlecock across a net. The structure of a traditional shuttlecock is comprised of natural feathers attached to a ball head. Natural feathers are mostly goose feathers or duck feathers, which are bleached and screened to make shuttlecocks. However, it is becoming more and more difficult to obtain natural feathers, and the screening processes are complicated and labor-intensive. Therefore, various types of artificial shuttlecocks emerge in the market in an attempt to solve the problems of natural feather shortage and complicated screening processes.

Most artificial shuttlecocks are made of nylon soft ball skirts to replace natural feathers, when the shuttlecock is being hit, the structure of the soft ball frame can bear the airflow to let the shuttlecock fly. However, the artificial shuttlecock made of this kind of soft ball skirt is not as good as natural feather shuttlecock (hereinafter referred to as natural shuttlecock) in terms of impact resistance, possible hitting speed and hitting feeling, so it is difficult for players to accept artificial shuttlecocks.

In order to solve the aforementioned problems, badminton manufacturers have proposed an artificial shuttlecock, which is to make a feather and a stem respectively with plastic materials, attach the feather to the stem, and then assemble it to the ball head. This kind of plastic artificial shuttlecock provides a better structure than the soft ball frame, but it still cannot match the hitting feeling and flight performance of those of natural shuttlecocks, so there is still room for improvement.

SUMMARY

In view of the above-mentioned problems, the main object of the present disclosure is to provide an artificial shuttlecock, which includes a plurality of feathers and a plurality of stems, and to improve the poor performance of artificial shuttlecock by using the novel structural design of the feathers and stems.

In order to achieve the above object, the present disclosure provides an artificial shuttlecock, which comprises a ball head, a plurality of feathers, and a plurality of stems. Each of the feathers comprises a connecting portion, a first portion, a second portion, and a notch. The first portion and the second portion are respectively disposed on two opposite sides of the connecting portion. The notch is disposed on an outer edge of the second portion. The stems respectively have an opposing ball end and a feather end. The ball end is connected to the ball head. The feather end is connected to at least one of the feathers, and the feather end is connected to the connecting portion. Each of the stems comprises a body. The body tapers from the end close to the ball end to the feather end, wherein the end of the body close to the ball end has a first width, and the body has a second width at the feather end. The first width is between 2.1 mm and 2.4 mm, and the second width is between 0.4 mm and 0.6 mm. The body is made of a carbon fiber reinforced material.

According to an embodiment of the present disclosure, the stem has a thickness between 0.4 mm and 0.6 mm.

According to an embodiment of the present disclosure, the thickness of the stem is 0.55 mm, and the first width is 2.21 mm.

According to an embodiment of the present disclosure, the thickness of the stem is 0.55 mm, and the first width is between 2.18 mm and 2.23 mm.

According to an embodiment of the present disclosure, the thickness of the stem is 0.55 mm, and the second width is between 0.48 mm and 0.53 mm.

According to an embodiment of the present disclosure, the thickness of the stem is 0.55 mm, and the second width is 0.51 mm.

According to an embodiment of the present disclosure, the stem further includes a tip to the body and disposed at the ball head end.

According to an embodiment of the present disclosure, the tip is made of carbon fiber reinforced material.

According to an embodiment of the present disclosure, the feather further includes an opening disposed at the first portion.

According to an embodiment of the present disclosure, the carbon fiber reinforced material is a composite material including a carbon fiber material and a glass fiber material.

In view of the above, the artificial shuttlecock according to the present disclosure comprises a ball head, a plurality of feathers and a plurality of stems. The feathers have a notch to form irregular feathers. Furthermore, the body of the stem tapers from the end close to the ball head end to the feather end. Specifically, the end of the body close to the ball head end has a first width, the body has a second width at the feather end, and the first width is greater than the second width. In addition, the stem is made of carbon fiber reinforced material, and the first width of the body is between 2.1 mm and 2.4 mm, and the second width is between 0.4 mm and 0.6 mm, thereby making the artificial shuttlecock similar to a shuttlecock made of natural feathers in terms of aerodynamic stability and flight performance.

DETAILED DESCRIPTION OF THE EMBODIMENTS

In order to make the structure and characteristics as well as the effectiveness of the present disclosure to be further understood and recognized, the detailed description of the present disclosure is provided as follows along with embodiments and accompanying figures.

Figure 1:
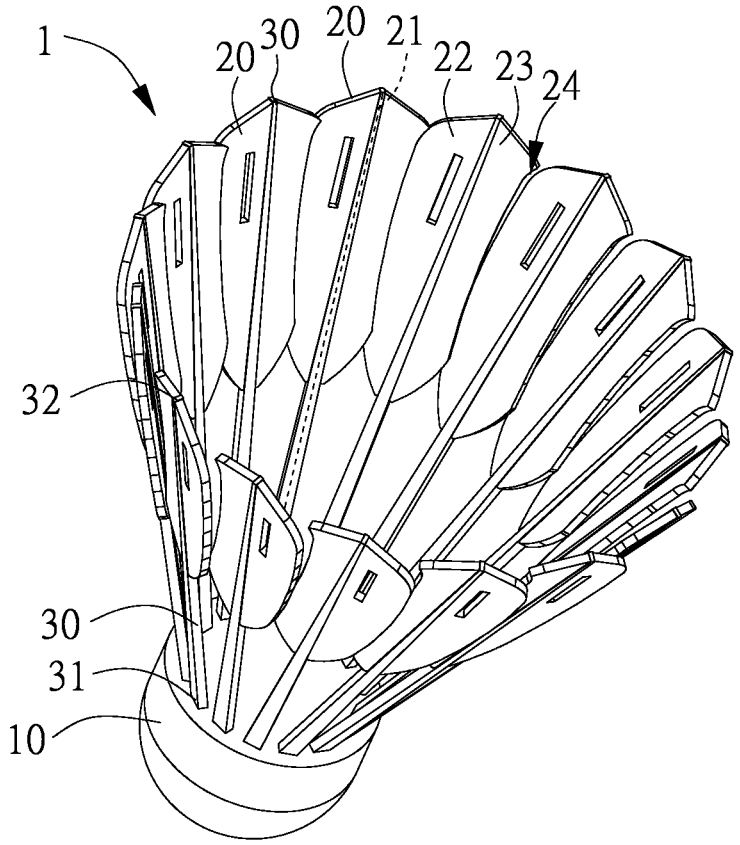
FIG. 1 is a schematic diagram of a shuttlecock according to an embodiment of the present disclosure.
Figure 2:
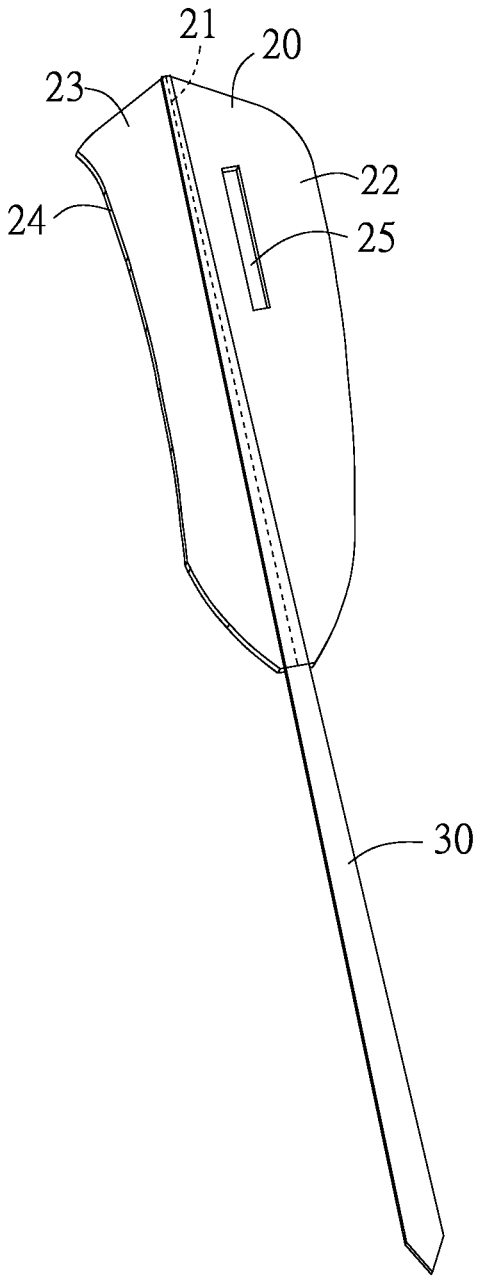
FIG. 2 is a schematic diagram of a feather and a stem shown in FIG. 1.
Figure 3:
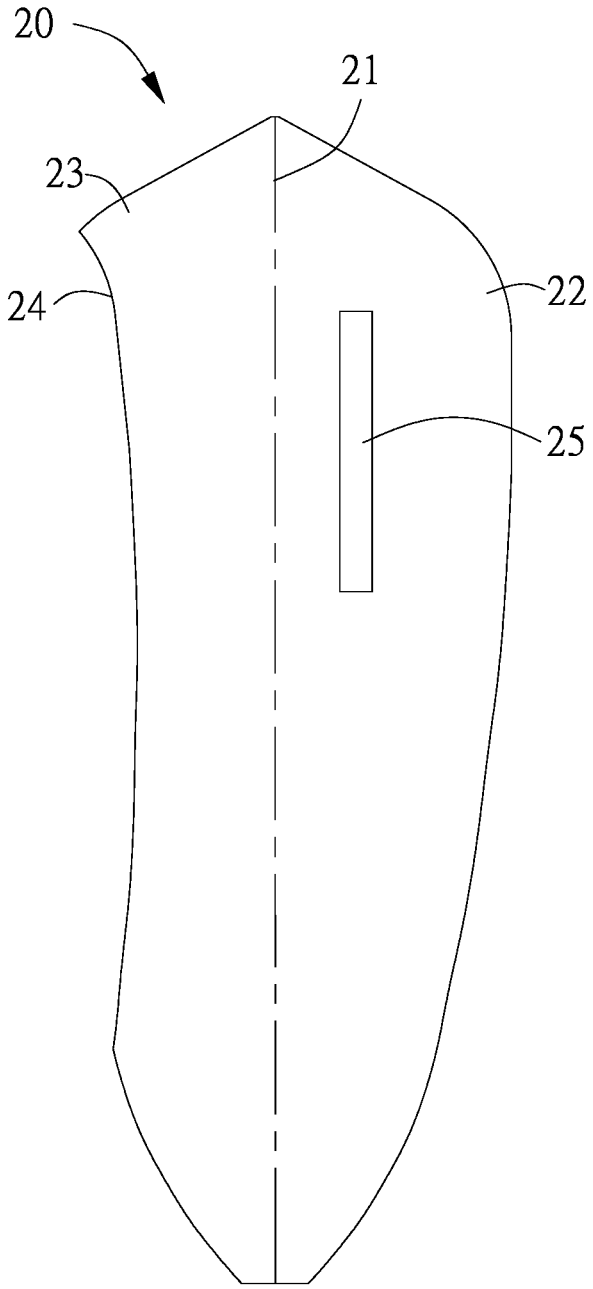
FIG. 3 is a schematic diagram of the feather shown in FIG. 2.
Figure 4:
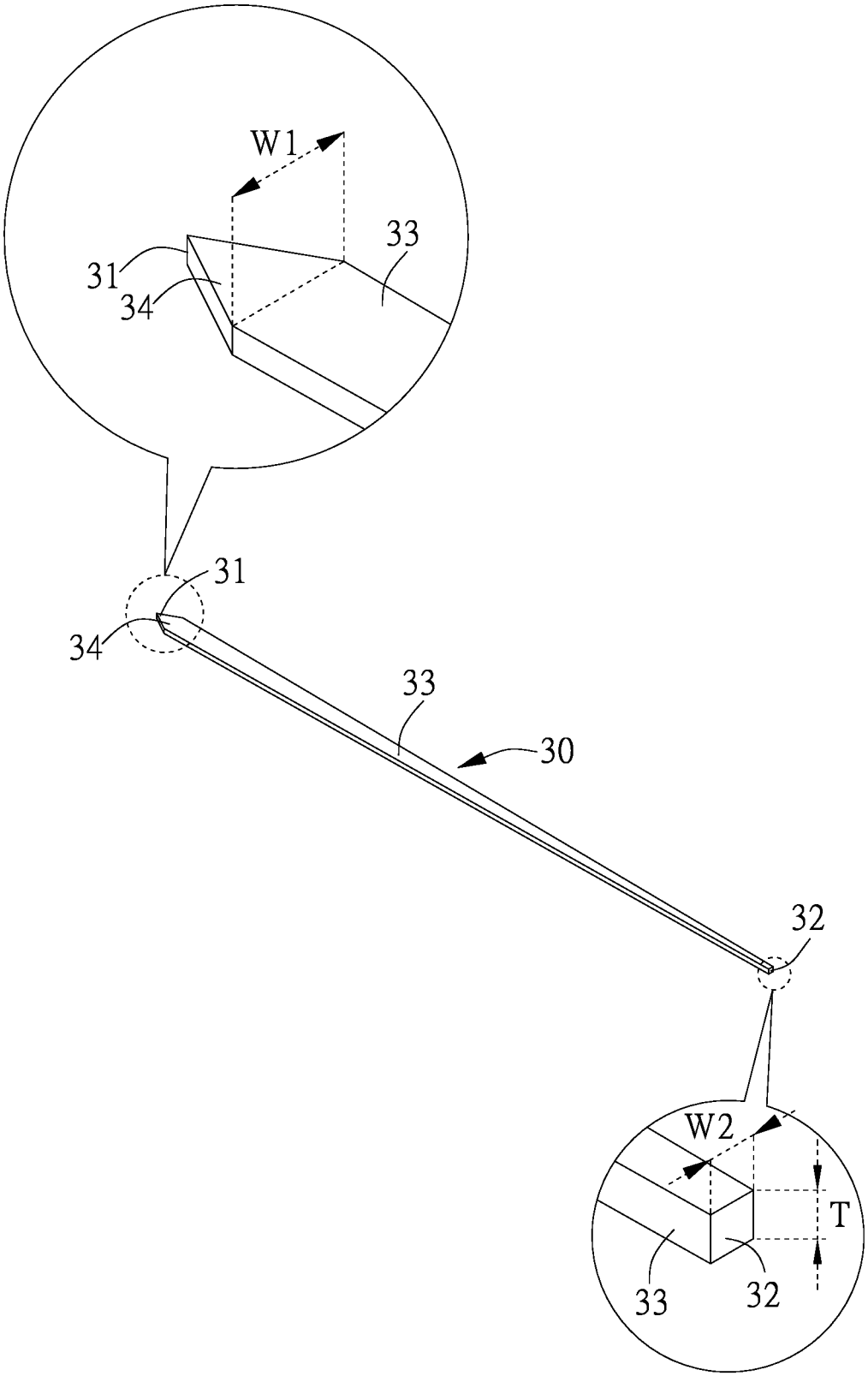
FIG. 4 is a schematic diagram of the stem shown in FIG. 2.

FIG. 1 illustrates a schematic diagram of a shuttlecock according to an embodiment of the present disclosure; FIG. 2 illustrates a schematic view of the feather and stem shown in FIG. 1; FIG. 3 illustrates a schematic view of the feather shown in FIG. 2; and FIG. 4 illustrates a schematic view of the stem shown in FIG. 2. Refer to FIG. 1 and FIG. 2, the artificial shuttlecock 1 of the present embodiment includes a ball head 10, a plurality of feathers 20 and a plurality of stems 30. The plurality of stems 30 is arranged on the ball head 10 at intervals, and one end of each stem 30 is inserted into the ball head 10, and a feather 20 is arranged on the other end. Specifically, each stem 30 has a ball head end 31 and a feather end 32 opposite to each other. The ball head end 31 is connected to the ball head 10, and the feather end 32 is connected to at least one of the feathers 20. In other words, the ball head end 31 of each stem 30 is connected to the ball head 10, and the feather end 32 is connected to the feather 20. In addition, one feather 20 can be connected to the stem 30, or two feathers 20 can be connected to opposite sides of one stem 30, however, this embodiment is not limited thereto.

In this embodiment, the feather 20 is an artificial feather to replace natural feathers. The feather 20 is made of plastic material with a density between 0.9 g/cm$^3$ and 1.48 g/cm$^3$, wherein the plastic material can be, for example but not limited to, low density polyethylene (LDPE), linear low density polyethylene (LLDPE), polyethylene terephthalate (PET), polyethylene (PE), polypropylene (PP), acrylonitrile-butadiene-styrene (ABS), polyamide (PA), extruded polyethylene (EPE) and so on. Preferably, the feather 20 can be a combination of low density polyethylene (LDPE) and linear low density polyethylene (LLDPE).

In this embodiment, each feather 20 includes a connecting portion 21, a first portion 22, a second portion 23, and a notch 24. The connecting portion 21 refers to the place where the feather 20 is connected to the stem 30, that is, the connecting portion 21 is connected to one of the plurality of stems 30, and the feather end 32 of the stem 30 is connected to the connecting portion 21. For example, a glue can be coated on the stem 30 first, and then one or two feathers 20 are placed on the glue-coated stem 30, and the feather 20 and the feather 20 are connected by thermocompression bonding. The portion where the feather 20 is bonded to the stem 30 is the connecting portion 21. In this embodiment, the portions on both sides of the connecting portion 21 are respectively referred to as the first portion 22 and the second portion 23. In other words, the first portion 22 and the second portion 23 are respectively located on opposite sides of the connecting portion 21.

Also, the notch 24 is disposed on the outer edge of the second portion 23, so that the feather 20 of this embodiment has an irregular shape, which refers to a non-kite structure. For example, a notch 24 is formed on the outer edge of the second portion 23 by cutting. Preferably, the profile of the notch 24 can correspond to the adjacent feathers 20. Specifically, the adjacent two feathers of the conventional shuttlecock are partially overlapped. In this embodiment, a notch 24 is formed by cutting the second portion 23 according to the overlapping shape, and the notch 24 is disposed outside the first portion 22 of the adjacent feathers 20, as shown in FIG. 1. In addition, when the artificial shuttlecock 1 composed of the irregular feathers 20 (with the notch 24) is hit, its aerodynamic stability and flight performance are better than those of the conventional artificial shuttlecock.

Preferably, the feather 20 of this embodiment further includes an opening 25, and the opening 25 is disposed on the first portion 22. The opening 25 can be an elongated structure, preferably rectangular, and the long axis of the opening 25 can be parallel to the connecting portion 21. Specifically, a cutter can be used to cut the second portion 23 to cut off part of the polyethylene material of the feather 20. The cutter is preferably a rectangular structure. After the long axis of the cutter is arranged parallel to the connecting portion 21 and corresponds to the second portion 23, the second portion 23 of the feather 20 is cut to form a rectangular incision, thereby forming the opening 25. In other embodiments, an opening 25 can also be formed between the first portion 22 and the notch 24, however, the present disclosure is not limited thereto.

As shown in FIG. 4, the stem 30 includes a body 33, wherein the body 33 tapers from the end close to the ball head end 31 to the feather end 32. Specifically, the end of the body 33 close to the ball head end 31 has a first width W1, the body 33 has a second width W2 at the feather end 32, and the first width W1 is greater than the second width W2. It is noted that the stem 30 further includes a tip 34, which is a triangular structure to be inserted into the ball head 10. One side of the tip 34 is connected to the body 33 and disposed at the ball head end 31. Therefore, the body 33 described herein does not include the tip 34 at the ball head end 31.

In this embodiment, the body 33 is made of a carbon fiber reinforced material. Preferably, the tip 34 is also made of a carbon fiber reinforced material. In other words, the stem 30 of this embodiment is made of carbon fiber reinforced material. The carbon fiber reinforced material is a composite material, which includes a carbon fiber material and a glass fiber material. Preferably, the carbon fiber reinforced material in this embodiment may be composed of carbon fiber materials and glass fiber materials stacked together.

The present disclosure provides the stem 30 made of carbon fiber reinforced material, which can produce better hitting feeling and flight performance. In this embodiment, the first width W1 can be between 2.1 mm and 2.4 mm, and the first width W1 includes 2.1 mm and 2.4 mm. Also, the second width W2 is between 0.4 mm and 0.6 mm, and the second width W2 includes 0.4 mm and 0.6 mm. Preferably, the stem 30 has a thickness T, wherein the thickness T can be between and including 0.4 mm and 0.6 mm. When the thickness T of the stem 30 is 0.55 mm, the first width W1 can be between and including 2.18 mm and 2.23 mm; and the second width W2 can be between and including 0.48 mm and 0.53 mm. Preferably, when the thickness T of the stem 30 is 0.55 mm, the first width W1 can be 2.21 mm, and the second width W2 can be 0.51 mm. By restricting the sizes of the thickness T, the first width W1, and the second width W2 of the stem 30, the airflow generated when the artificial shuttlecock 1 is hit is similar to that of a shuttlecock made of natural feathers, thereby improving the aerodynamic stability and flight performance when the artificial shuttlecock 1 is hit.

In view of the above, the artificial shuttlecock according to the present disclosure comprises a ball head, a plurality of feathers and a plurality of stems. The feathers have a notch to form irregular feathers. Furthermore, the body of the stem tapers from the end close to the ball head end to the feather end. Specifically, the end of the body close to the ball head end has a first width, the body has a second width at the feather end, and the first width is greater than the second width. In addition, the stem is made of carbon fiber reinforced material, and the first width of the body is between 2.1 mm and 2.4 mm, and the second width is between 0.4 mm and 0.6 mm, thereby making the artificial shuttlecock similar to a shuttlecock made of natural feathers in terms of aerodynamic stability and flight performance.

It should be noted that many of the above-mentioned embodiments are given as examples for description, and the scope of the present invention should be limited to the scope of the following claims and not limited by the above embodiments.

What is claimed is:

1. An artificial shuttlecock comprising:

a ball head;

a plurality of feathers, each the plurality of feathers comprising:

a connecting portion;

a first portion and a second portion respectively disposed on two opposite sides of the connecting portion; and a notch disposed on an outer edge of the second portion; and a plurality of stems having a ball head end and a feather end opposite to each other, wherein the ball head end is connected to the ball head, and the feather end is connected to at least one of the feathers, and the feather end is connected to the connecting portion, and each of the stems comprises:

a body tapered from an end close to the ball head end to a feather end, the end of the body close to the ball head end having a first width, the body at the end of the feather having a second width, wherein the first width is between 2.1 mm and 2.4 mm, the second width is between 0.4 mm and 0.6 mm, and the body is made of a carbon fiber reinforced material.

2. The artificial shuttlecock as claimed in claim 1, wherein the stem has a thickness between 0.4 mm and 0.6 mm.

3. The artificial shuttlecock as claimed in claim 2, wherein the thickness of the stem is 0.55 mm, and the first width is between 2.18 mm and 2.23 mm.

4. The artificial shuttlecock as claimed in claim 3, wherein the thickness of the stem is 0.55 mm, and the first width is 2.21 mm.

5. The artificial shuttlecock as claimed in claim 2, wherein the thickness of the stem is 0.55 mm, and the second width is between 0.48 mm and 0.53 mm.

6. The artificial shuttlecock as claimed in claim 5, wherein the thickness of the stem is 0.55 mm, and the second width is 0.51 mm.

7. The artificial shuttlecock as claimed in claim 1, wherein the stem also includes a tip connected to the body and disposed at the ball head end.

8. The artificial shuttlecock as claimed in claim 7, wherein the tip is made of the carbon fiber reinforced material.

9. The artificial shuttlecock as claimed in claim 1, wherein the feather further comprises an opening disposed at the first portion.

10. The artificial shuttlecock as claimed in claim 1, wherein the carbon fiber reinforced material is a composite material including a carbon fiber material and a glass fiber material.

* * * * *